US005501082A

United States Patent [19]

Tachibana et al.

[11] Patent Number: 5,501,082

[45] Date of Patent: Mar. 26, 1996

[54] REFRIGERATION PURGE AND/OR RECOVERY APPARATUS

[75] Inventors: Keiji Tachibana, Tokyo; Susumu Ishii, Tsuchiura; Michio Kumaki, Toda; Takeo Genba, Ibaraki, all of Japan

[73] Assignee: Hitachi Building Equipment Engineering Co., Ltd., Tokyo, Japan

[21] Appl. No.: 76,641

[22] Filed: Jun. 15, 1993

[30] Foreign Application Priority Data

Jun. 16, 1992 [JP] Japan ..... 4-156912
Oct. 23, 1992 [JP] Japan ..... 4-286043

[51] Int. Cl.[6] ..... F25B 45/00

[52] U.S. Cl. ..... 62/149; 62/195; 62/292

[58] Field of Search ..... 62/149, 195, 292, 62/475, 77, 85

[56] References Cited

U.S. PATENT DOCUMENTS 5,167,126 12/1992 Cartwright ..... 62/149
5,230,224 7/1993 Ricketts et al. .

*Primary Examiner*—John M. Sollecito

*Attorney, Agent, or Firm*—Sixbey, Friedman, Leedom & Ferguson; Gerald J. Ferguson, Jr.

[57] ABSTRACT

An improved refrigerant recovery method and apparatus by which a refrigerant charged in a refrigerator is transferred into a refrigerant tank are disclosed. The apparatus is adapted to discharge almost all the refrigerant gas from the refrigerator and purge non-condensible gases from a safety valve to the atmosphere with little refrigerant gas accompanying the non-condensible gases. There are provided a vacuum pump at the upstream side of a line connected between the refrigerator and a liquid separator, and a compressor at the downstream side thereof, the vacuum pump and compressor being connected in series with each other. The vacuum pump is intended to nearly zero the pressure of the remaining refrigerant gas in the refrigerator and the compressor is to give the liquid separator a desired internal pressure, thereby minimizing the amount of refrigerant gas purged along with the non-condensible gases to the atmosphere. Also a bypass valve is provided to bypass the vacuum pump. By opening the bypass valve to activate the compressor independently with the vacuum pump put out of operation to circulate the refrigerant liquid accumulating in the lower portion of the liquid separator to the refrigerator, it is possible to purge the non-condensible gases to the atmosphere during operation of the refrigerator.

7 Claims, 11 Drawing Sheets

REFRIGERATION PURGE AND/OR RECOVERY APPARATUS

BACKGROUND OF THE INVENTION a) Field of the Invention

The present invention relates to a method for transfer of the refrigerant charged in a refrigerator into a refrigerant tank, provided separately from the refrigerator, without release of the refrigerant into the atmosphere and an apparatus suitable for carrying out the method as well as to a method for purging to the atmosphere non-condensible gases, having entered into the refrigerating cycle and mixed in the refrigerant gas, without release of the refrigerant into the atmosphere and an apparatus suitable for carrying out the method.

b) Prior Art Statement

Generally in the refrigerator, a charged refrigerant having a boiling point which is nearly the same as the normal temperature (for example, Fron gas CFC-11) repeatedly passes through a refrigerating cycle from evaporation, compression, condensation, pressure reduction, and then back to evaporation. When the refrigerator is disassembled totally or partially for the purpose of inspection or repair, the refrigerant is likely to be released into the atmosphere. To prevent the refrigerant from being thus dissipated to the atmosphere, the refrigerant is extracted from the refrigerating system of the refrigerator beforehand, collected into a refrigerant tank and temporarily stored therein. After completion of the inspection or repair, the refrigerant is returned from the refrigerant tank into the refrigerator.

In many of the refrigerators, non-condensible gases such as air and condensible contaminants such as water or steam having entered from outside exist together with the refrigerant gas and liquid.

Since the refrigerant liquid can be recovered relatively easily into a container such as refrigerant tank, it is extracted prior to recovery of refrigerant gas.

The refrigerant gas is liquified for recovery while the non-condensible gases and steam are separated from the refrigerant for purge to the atmosphere.

Fig. 1 is a schematic illustration of a conventional refrigerant recovery apparatus. The reference numeral 1 denotes a refrigerator. This refrigerator 1 has a refrigerating system comprising a condenser 1*a*, evaporator 1*b* and a compressor 1*c*. The refrigerating system has charged therein a refrigerant (for example, Fron gas CFC-11). For recovery of the refrigerant gas from the refrigerating system into a refrigerant tank 5, the refrigerant gas in the refrigerator 1 is sucked and forced by the compressor 2 and liquified as cooled by the condenser 3. Non-condensible gases such as air are mixed in the refrigerant gas and also the air contains more or less condensible contaminants such as water or steam. The refrigerant and others liquified by the condenser 3 are led into a liquid separator 4 where only the refrigerant liquid is recovered into the refrigerant tank 5 via a float valve 4*a*, while the non-condensible gases are purged to the atmosphere though a safety valve 4*b*. The gases contain the refrigerant gas having not been condensed. The reference symbol W denotes a window through which the cumulation of the liquified moisture is viewed and v a drain valve.

As having been described above, the important technical matter in the "recovery" process lies in the separation of the non-condensible gases mixed in the refrigerant gas. The separated non-condensible gases have no economical value and so they are purged to the atmosphere.

This "separation of mixed non-condensible gases" is also essential for the "purge" process which will also be described below with reference to FIG. 1.

The refrigerant under a low pressure, such as CFC-11, charged in the refrigerator 1 repeatedly goes through the aforementioned refrigerating cycle from evaporation to pressure reduction trough compression and condensation. Namely, it passes through a lower pressure than the atmospheric pressure. Therefore, air is likely to enter into the refrigerator 1 from the mechanical joints thereof so, the above-mentioned air contains condensible contaminants such as water or steam. The non-condensible gases, thus mixed into the refrigerant will cause the efficiency of the refrigerator to be lower. For maintaining or raising the refrigerator's efficiency, it is necessary to separate from the refrigerant gas the non-condensible gases, having entered into the refrigerator 1, for purge of the gases to the atmosphere. Also in this case, care must be taken for the refrigerant gas not to be purged together with the non-condensible gases to the atmosphere. To this end, a purge apparatus indicated with a solid line in Fig. 1 is utilized to return the refrigerant liquid having accumulated in the lower portion of the liquid separator 4 to the refrigerator 1 as indicated with an imaginary line with an arrow a and circulate it again through the refrigerating system, not to pass it into the refrigerant tank 5. Owing to this recirculation, the non-condensible gases are separated into the upper portion of the liquid separator 4 and released or purged through the safety valve 4*b* into the atmosphere.

As will be easily understandable from the above description, both the recovery and purge techniques have a common point that "only the non-condensible gases mixed in the refrigerant gas charged in the refrigerating cycle are purged to the atmosphere without losing the refrigerant gas".

In 1950's, the refrigerant was expensive and it was the economical and technical ideas to recover the refrigerant without dissipation thereof. For this purpose, it was proposed to use a conventional refrigerant recovery apparatus shown by way of example in FIG. 1. Standing on the ideas of the times, however, no efforts were made to thoroughly recover the refrigerant with higher costs than the price of the refrigerant itself.

In 1960's, various kinds of environmental pollution became an object of social concern. In 1980's, the ozone-layer destruction by Fron gas used as the refrigerant and solvent was put into dispute as a global environmental problem, and now is a time for inhibiting the dissipation of Fron into the atmosphere by recovering it thoroughly even with greater costs than the monetary value of the recovered Fron.

The prior art shown in FIG. 1 will be discussed below from the above standpoints. For recovery of the refrigerant for the purpose of inspecting the refrigerator or for a similar reason, first the refrigerant liquid is recovered and then the remaining refrigerant gas in the refrigerator is recovered. Even if the refrigerant gas in the refrigerator 1 is discharged to the full possible extent by the compressor 2, the gas pressure in the refrigerator 1 will generally fall only to 14.7 kPa. The 14.7 kPa refrigerant gas is likely to be released into the atmosphere during the disassembling and repair of the refrigerator 1. To lower the pressure of the remaining refrigerant gas in the refrigerant 1 down to about 0 to 1.33 kPa, a conventional technique using a vacuum pump 9 as shown in FIG. 2 can be used as well known to those skilled in the art. In the conventional technique shown in FIG. 2, however, the pressure of the remaining refrigerant gas in the refrigerator 1 can be lowered nearly to 0 Pa but since the delivery pressure of the vacuum pump 9 is low, the pressure of non-condensible gases in the upper space inside the liquid separator 4 will only rise up to 130 kPa. These non-condensible gases also contain a yet-to-be-condensed refrigerant gas having a partial pressure equivalent to be condensation temperature in the condenser 3. The yet-to-be-condensed refrigerant gas has a density inversely proportional to the pressure in the liquid separator 4. If the pressure is low, the partial pressure of the refrigerant gas is high as compared with that of the non-condensible gases, so that the yet-to-be-condensed refrigerant gas will have a higher density. Therefore, the high-density yet-to-be-condensed refrigerant gas will be released into the atmosphere together With the non-condensible gases purged into the atmosphere from the safety valve **4*b***. Such problem will take place during the recovery process as well as during the purge process.

SUMMARY OF THE INVENTION

It is therefore an object of the present invention to overcome the above-mentioned drawbacks of the prior art by providing a refrigerant recovery method and apparatus by which the pressure of the remaining refrigerant gas in a refrigerator can be lowered to an ideal level (about 0 Pa) and the pressure of the non-condensible gases in a liquid separator can be raised (up to, for example, 590 kPa), whereby the sum of the amount of the refrigerant remaining in the refrigerator and released into the atmosphere and that of the refrigerant gas dissipated from a safety valve into the atmosphere along with the non-condensible gases can be decreased to an amount which can be practically regarded as zero, and also a refrigeration purge method and apparatus by which the amount of the refrigerant gas contained in the non-condensible gases purged to the atmosphere can be considerably reduced.

The basic principle of the present invention worked out to accomplish the above object (that is, the reduction in amount of the remaining refrigerant gas in the refrigerator and the reduction in content of the refrigerant gas in the non-condensible gases purged to the atmosphere) will be described below.

According to the present invention, a vacuum pump and compressor are used in conjunction. Because of the high suction power of the vacuum pump, the gas (a mixture of refrigerant gas and non-condensible gases) in the refrigerator can be discharged nearly completely. Also, as the delivery force of the compressor is high, the pressure of the gas mixture in the liquid separator can be made high. Thus, the partial pressure of the refrigerant gas can be made lower than that of the non-condensible gases.

It should be noted that the vacuum pump is included in a compressor taken in a broad sense, but it is adapted to suck and purge to the atmosphere a "gas having a pressure ranging from under the atmospheric pressure to the absolute vacuum". The differences of the vacuum pump from a compressor taken in a narrow sense are (a) an extremely large pressure ratio, (b) a larger cylinder for its power because the object gas is thin, and (c) a smaller resistance of the valves and passages because the differential pressure is low. In the present invention, the vacuum pump refers to a gas pump which can raise the suction pressure up to a vacuum higher than 8.0 kPa. The vacuum pump is designed primarily for evacuation of a closed container to a high vacuum. Normally, the delivery pressure is set to the level of the atmospheric pressure or to a level somewhat higher than the latter, while the delivery pressure of the vacuum pumps industrially used in practice, except for the special vacuum pumps for experimental or laboratory use, is generally lower than 200 kPa.

Also in the present invention, the compressor is a gas pump of which the maximum delivery pressure is higher than 200 kPa. This compressor is designed mainly for a larger difference between the suction and delivery pressures. Although it is possible to lower the suction pressure to a certain extent by reducing the diameter of the suction piping, the suction pressure of compressors industrially used in practice is generally lower than 8.0 kPa.

When the gas mixture (refrigerant gas and non-condensible gases) in the refrigerator is sucked by the vacuum pump during the refrigerant gas recovery process until a higher vacuum than 1.33 kPa is attained, the amount of the remaining refrigerant in the refrigerator is nearly null. Therefore, even when the refrigerator is disassembled for repair after that, the amount of the refrigerant gas released into the atmosphere is extremely small. Further, since the pressure of the gas mixture in the liquid separator is raised by the compressor up to 200 to 600 kPa, the partial pressure of the refrigeration in the gas mixture is made lower than that of the non-condensible gases, so that the amount of the refrigerant gas contained in the non-condensible gases purged to the atmosphere can be considerably reduced.

In the refrigeration purge process, the gas mixture (refrigerant gas and non-condensible gases) in the refrigerator is sucked and compressed until a pressure of 200 to 600 kPa is reached. Thus the partial pressure of the refrigerant in the gas mixture in the liquid separator is made lower than that of the non-condensible gases, so that the content of the refrigerant gas in the non-condensible gases purged to the atmosphere can be made extremely small. In this case, if the temperature of the gas mixture can be made lower along with the rise of the pressure thereof, the partial pressure of the refrigerant gas in the gas mixture can be made further low with respect to that of the non-condensible gases, whereby the content of the refrigerant gas in the non-condensible gases purged to the atmosphere can be further reduced.

DETAILED DESCRIPTION OF THE PREFERRED EMBODIMENTS

Figure 3:
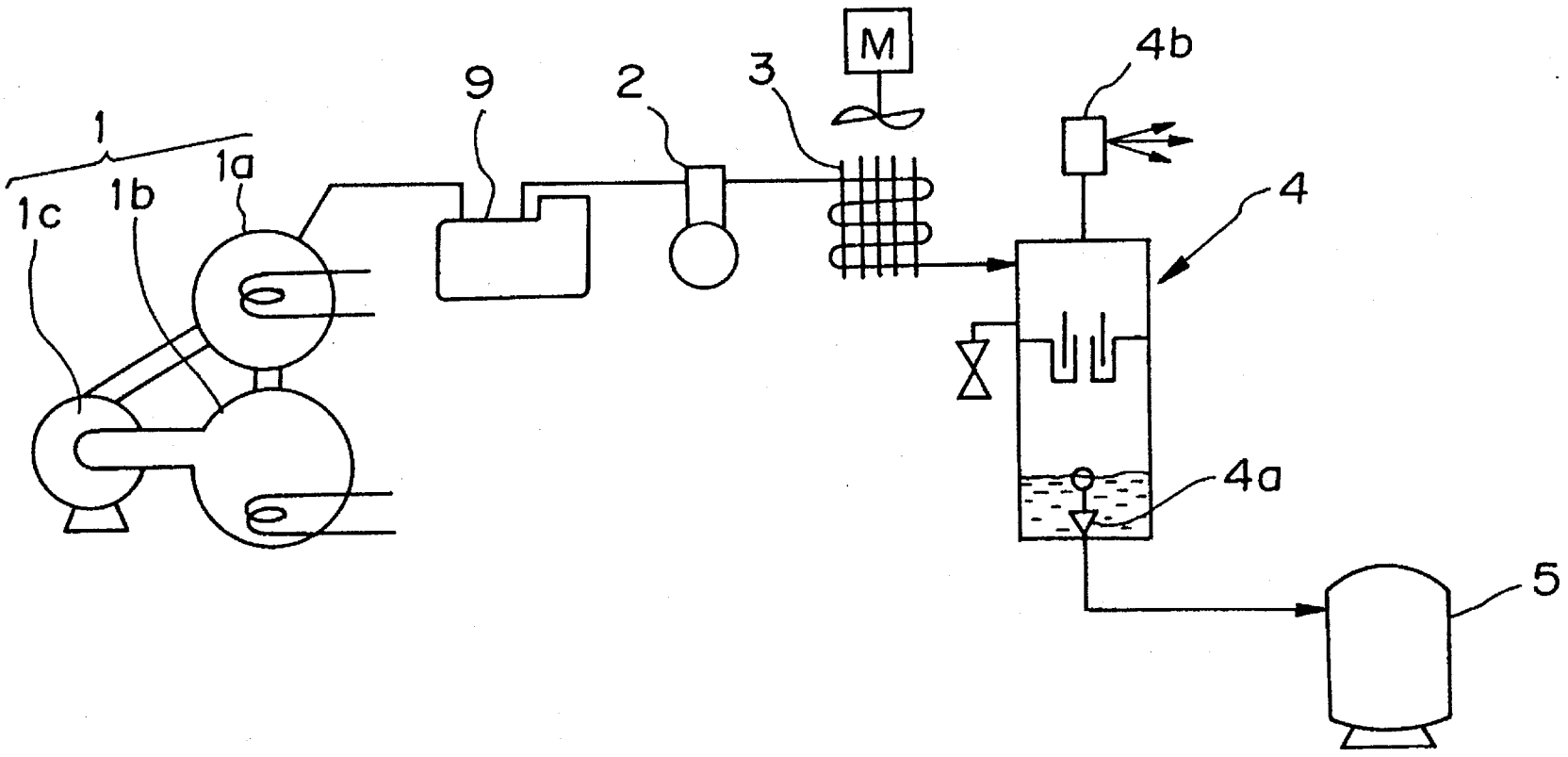
FIG. 3 is a schematic diagram of one embodiment of the refrigerant recovery according to the present invention.

FIG. 3 shows a refrigerant recovery apparatus according to the first embodiment of the present invention.

Figure 1:
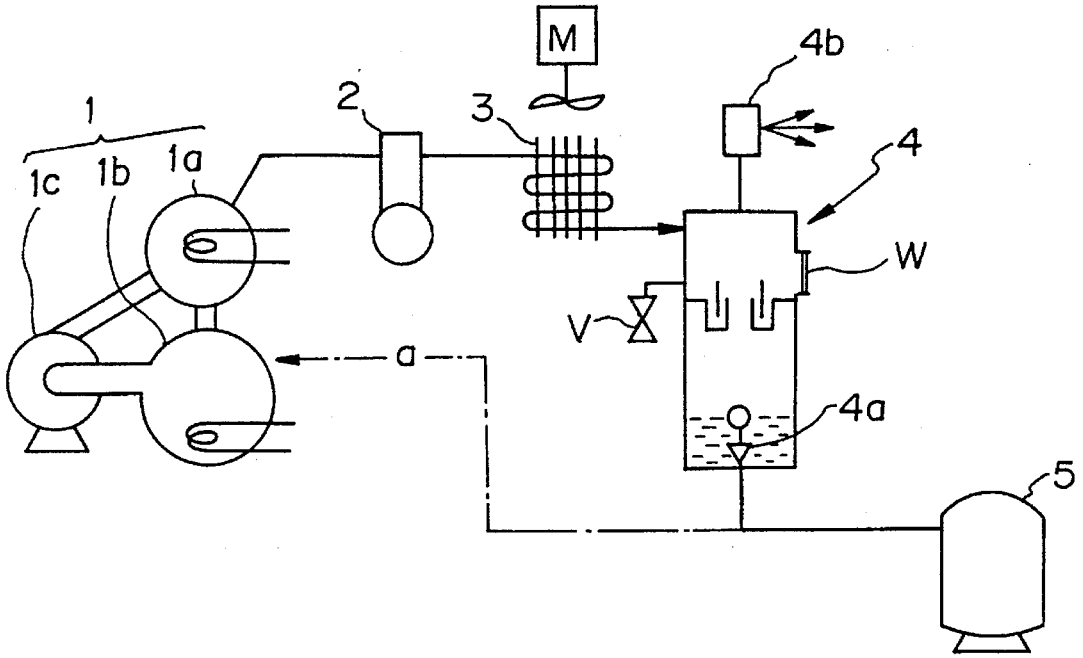
Fig.1 (PRIOR ART)
Fig. 1 is a schematic diagram of a conventional refrigerant recovery apparatus.

This first embodiment is an improved version of the prior art shown in FIG. 1 with a vacuum pump 9 connected between the refrigerator 1 and compressor 2.

Figure 2:
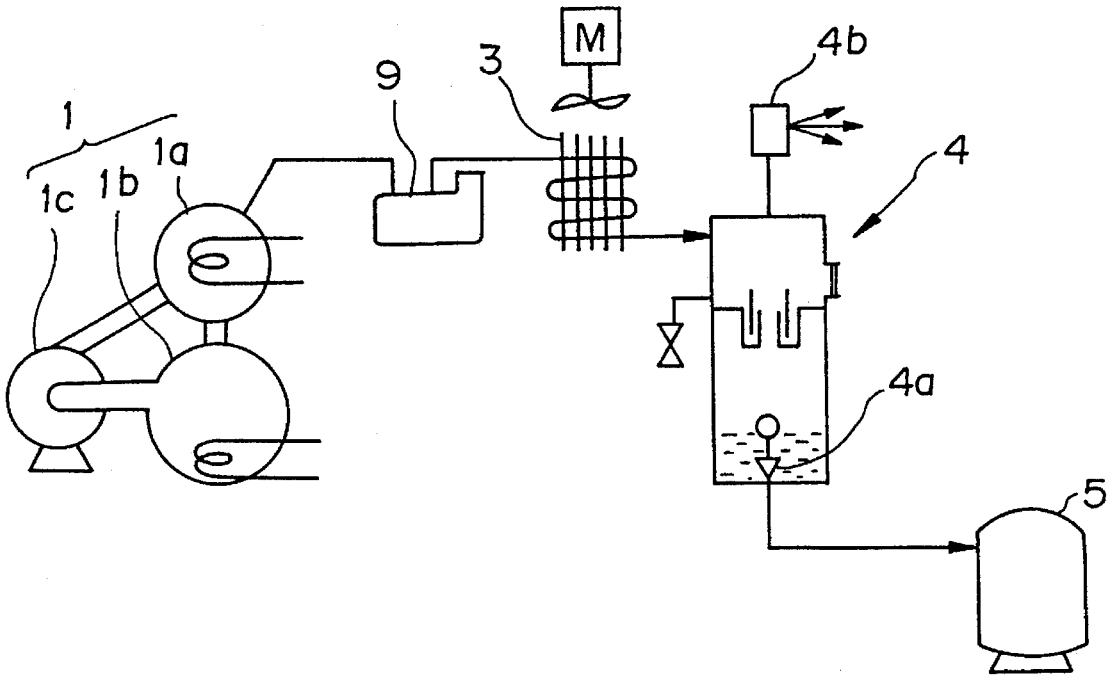
Fig.2 (PRIOR ART)
FIG. 2 is a schematic diagram of another conventional refrigerant recovery apparatus.

Also the refrigerant recovery apparatus shown in FIG. 3 is another improved version of the prior art shown in FIG. 2 with a compressor 2 connected between the vacuum pump 9 and condenser 3.

In the first embodiment of the refrigerant recovery apparatus according to the present invention shown in FIG. 3, the vacuum pump 9 can suck out the refrigerant gas until a high vacuum of about 0 Pa is attained, and so the amount of the remaining refrigerant in the refrigerator 1 is nearly null. The refrigerant gas delivered from the vacuum pump 9 is sucked, compressed and delivered by the compressor 2, cooled by the condenser 3 and led into the liquid separator 4.

The non-condensible gases having entered into the refrigerator and mixed in the refrigerant gas are compressed, accumulate in the upper space in the liquid separator 4, and are purged to the atmosphere through the safety valve **4*b*. The delivery pressure of this safety valve 4*b* is 590 kPa in this embodiment. Since the gases thus purged have been compressed to a pressure 590 kPa, the partial pressure of the yet-to-be-condensed refrigerant gas purged along with the non-condensible gases is lower than that of the non-condensible gases, so that the density of that yet-to-be-condensed refrigerant gas is low. The refrigerant liquid from which the non-condensible gases and yet-to-be-condensed refrigerant gas have been separated in the liquid separator 4 is led into the refrigerant tank 5 via the float valve 4*a***.

Figure 4:
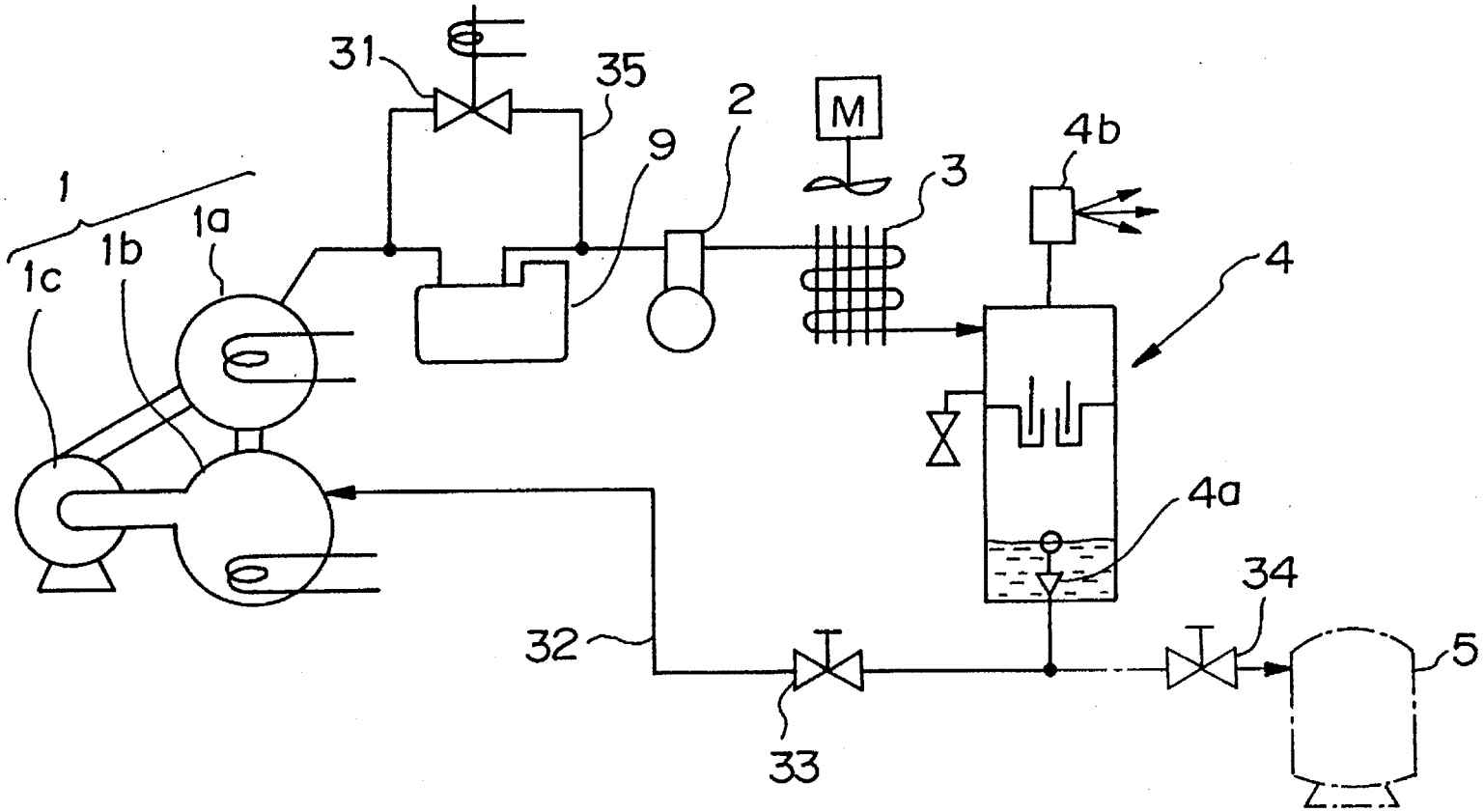
FIG. 4 is a schematic diagram of one embodiment of the refrigeration purge apparatus according to the present invention.

FIG. 4 is a schematic diagram of one embodiment of the refrigeration purge apparatus constructed using the essential components of the refrigerant recovery apparatus shown in FIG. 3. In this embodiment, the refrigerant tank 5 and its piping (indicated with an imaginary line) used in the refrigerant recovery apparatus in FIG. 3 are unused as shut off from the refrigerant circuit. There is provided a purge line 32 which connects the float valve **4*a* of the liquid separator 4 and the evaporator 1*b* of the refrigerator 1 to each other, the purge line having a valve 33 provided therein, and further there are provided a bypass line 35, having a bypass valve 31 provided therein, which provide for a bypass of the vacuum pump 9. Thus, non-condensible gases having entered into the refrigerator, 1 are suck and compressed along with the refrigerant gas by the compressor 2, and cooled by the condenser 3. The majority of the refrigerant gas is liquified and returned to the refrigerator 1 via a purge line 32, while the mixture of the refrigerant gas having not been liquified and non-condensible gases is separated from the refrigerant liquid in the liquid separator 4 and purged to the atmosphere through the safety valve 4*b***.

In this case, since the non-condensible gases having entered into the refrigerator 1 are smaller in specific gravity than the refrigerant gas, they stay in the upper portion in the refrigerator and sucked by the compressor 2. Thus, most of the non-condensible gases having entered into the refrigerant cycle is purged to the atmosphere.

In this embodiment, the bypass valve 31 is provided for the vacuum pump 9 as shown in FIG. 4. During the purge process, a valve 34 provided for the refrigerant tank 5 is closed while the valve 33 and the bypass valve 31 are opened, and the vacuum pump 9 is put out of operation. The the liquified refrigerant is returned to the refrigerator 1.

Figure 5:
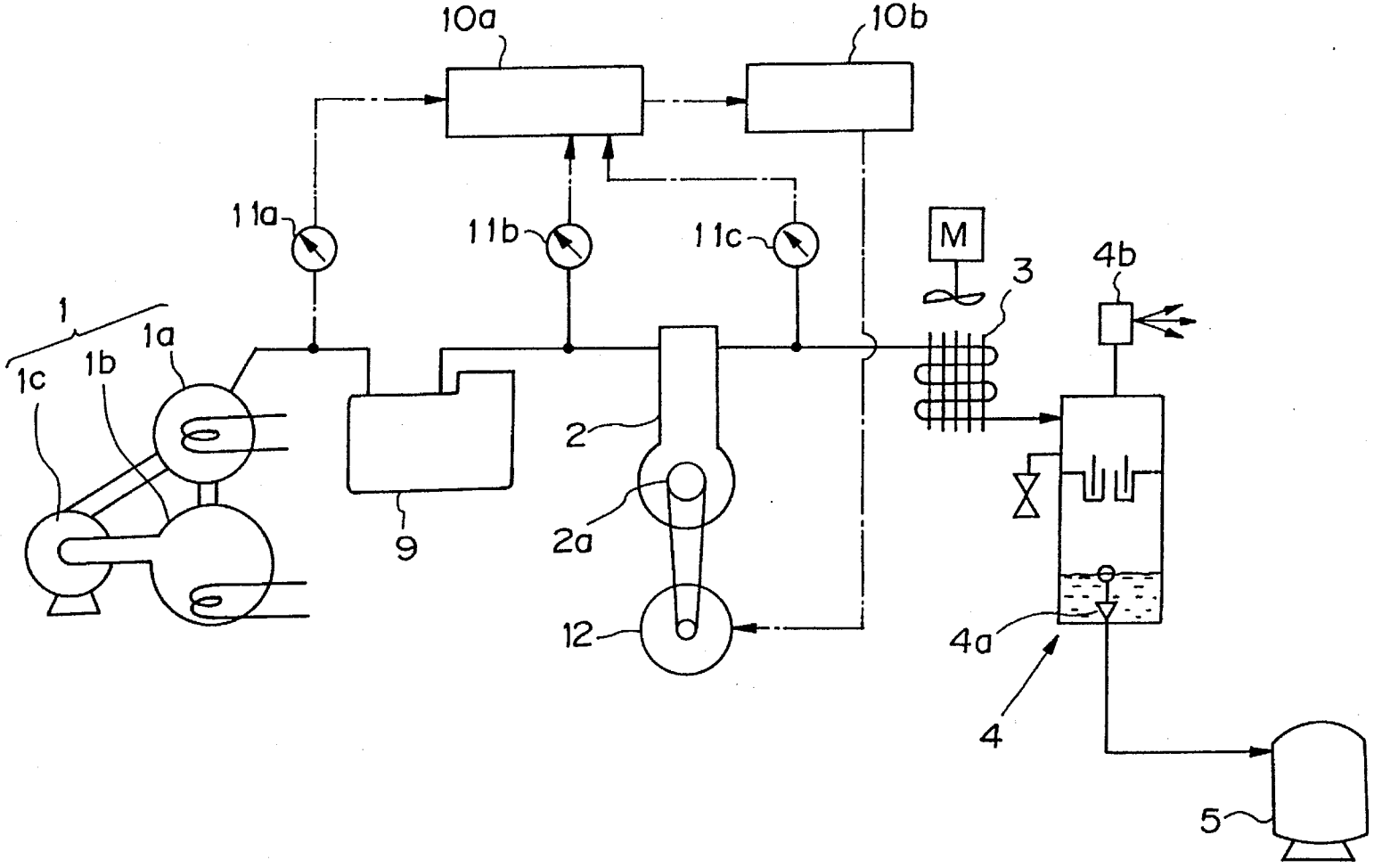
FIG. 5 is a schematic diagram of a second embodiment of the refrigerant recovery apparatus according to the present invention.

FIG. 5 schematically shows, as a second embodiment, a further improved version of the embodiment shown in FIG. 3. Since the vacuum pump 9 and compressor 2 are connected in series in one fluid line, it is necessary to balance the load between these components, but it is not easy. In this embodiment, pressure gauges **11*a* to 11*c* are provided and the compressors 2 has a drive motor 12** of which the speed is variable.

Output signal from each of these pressure gauges **11*a* to 11*c* is supplied to a microcomputer 10*a* serving as arithmetic unit, and a control signal, a result of the computation by the microcomputer 10*a*, is supplied to an inverter 10*b* which will control the speed of the variable-speed motor 12 to adjust the load to the compressor 2, thereby balancing the load between the vacuum pump 9 and compressor 2**.

Figure 6:
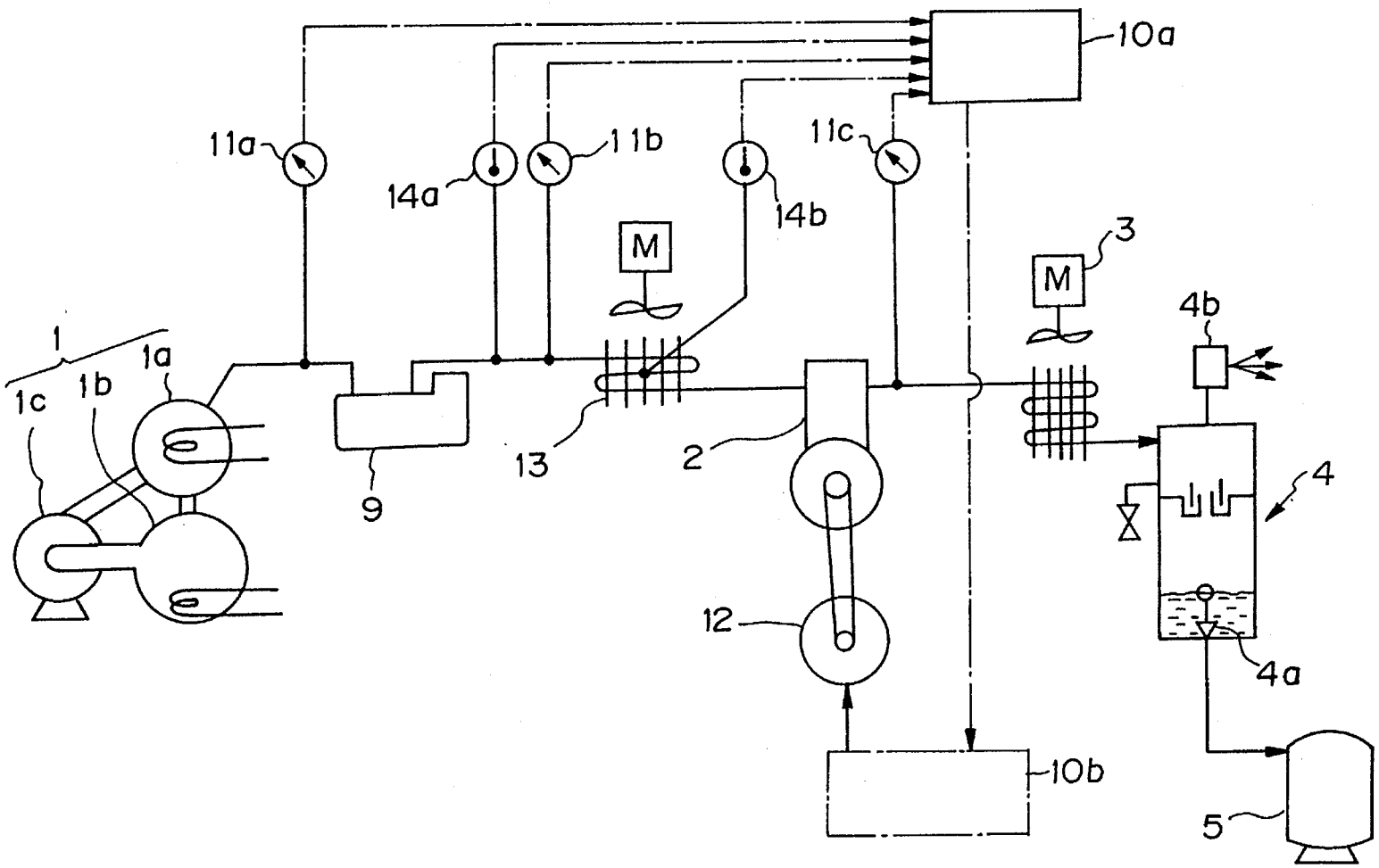
FIG. 6 is a schematic diagram of a third embodiment of the refrigerant recovery apparatus according to the present invention.

FIG. 6 schematically shows, as a third embodiment, a still another improved version of the embodiment shown in FIG. 5. The third embodiment is different from the embodiment in FIG. 3 in that a gas cooler 13 is provided between the vacuum pump 9 and compressor 2 and thermosensors **14*a* and 1*b* are provided as connected to the microcomputer 10*a*. In this third embodiment, the mixture of the refrigerant gas delivered from the vacuum pump 9 and the noncondensible gases is compressed and reduced in pressure as cooled by the gas cooler 13, so that the load to the compressor 2 is decreased. The thermosensors 14*a* and 14*b* detect the temperature in the refrigerant recovery system while the pressure gauges 11*a* to 11*c* detect the pressure in the recovery system. The signals from these pressure gauges and thermosensors are supplied to the microcomputer 10*a* serving as arithmetic unit. Output signal from this microcomputer 10*a* is supplied to the inverter 10*b* which will control the variable-speed motor 12 which in turn will control the speed of the compressor 2. The speed control is done in such a manner that the refrigerant gas in the gas cooler 13 will not be liquified. This is because the compressor 2** is designed as a gas pump. If it sucks the refrigerant in liquid phase, it will possibly be destructed.

Figure 7:
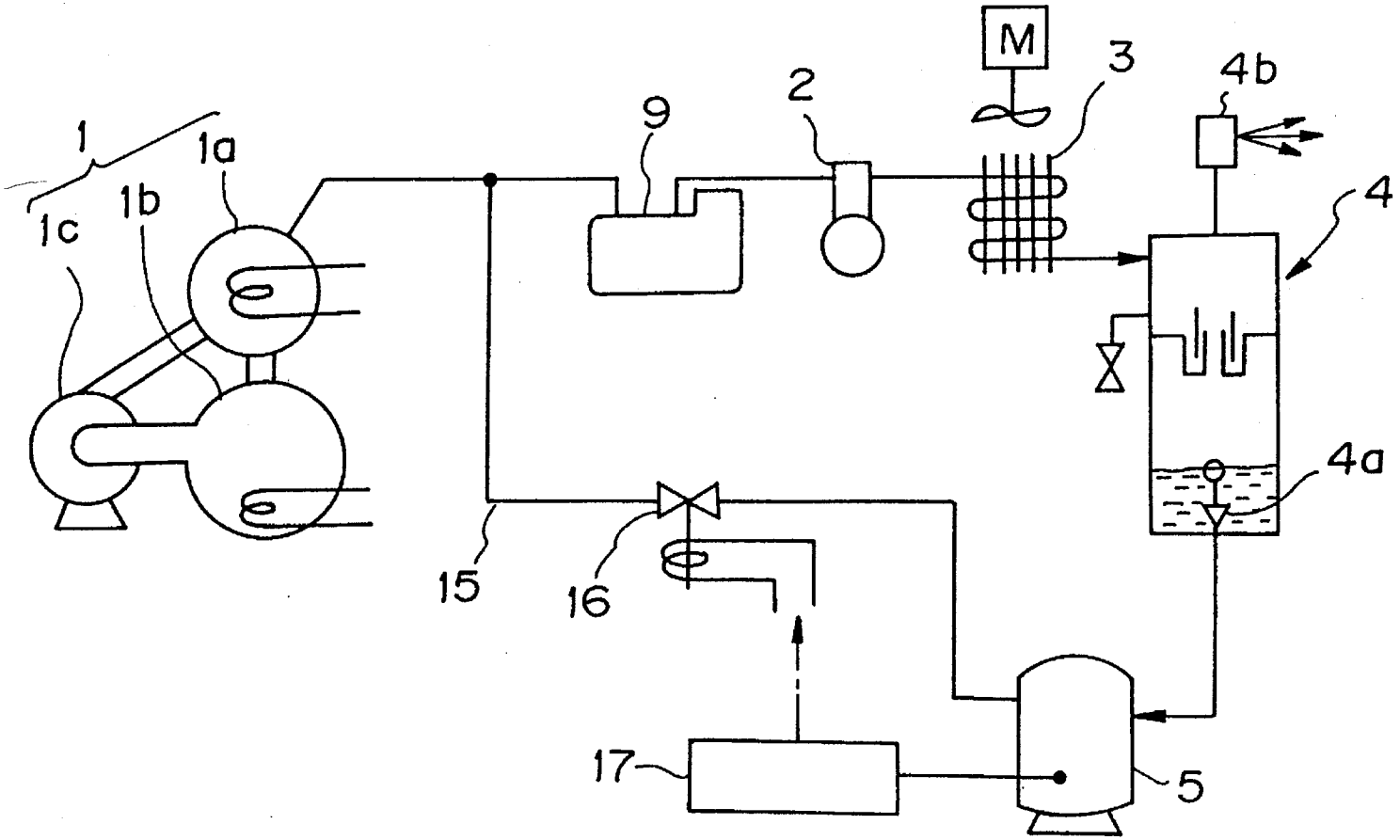
FIG. 7 is a schematic diagram of a fourth embodiment of the refrigerant recovery apparatus according to the present invention.

FIG. 7 schematically shows, as a fourth embodiment, a yet another improved version of the embodiment shown in FIG. 3. For the liquified refrigerant to flow into the refrigerant tank 5 from the liquid separator 4 through the float valve **4*a*, the pressure in the refrigerant tank 5 should preferably be low. However, the pressure in the refrigerant tank 5 is affected by the temperature of the incoming refrigerant liquid and the ambient temperature around the tank 5**, and it will be in equilibrium with the saturation pressure corresponding to these temperatures.

In this embodiment, the refrigerant tank 5 and the suction side of the vacuum pump 9 are connected to each other by means of an evaporation line 15 having an evaporation valve 16 provided therein. When the evaporation valve 16 is opened manually during the operation of the refrigerant recovery apparatus, the refrigerant gas in the refrigerant tank 5 is sucked by the vacuum pump 9. Thus the pressure in the refrigerant tank 5 falls, a part of the refrigerant liquid in the refrigerant tank 5 is evaporated and extracts the heat of evaporation from the refrigerant liquid. Thus, the temperature in the refrigerant tank 5 falls, so that the pressure in the refrigerant tank 5 will be in equilibrium with the reduced saturation pressure corresponding to the lowered temperature. In this embodiment, the evaporation valve 16 is an electrically actuated valve, and a thermosensor 17 is provided to detect the temperature of the refrigerant in the refrigerant tank 5. When the thermosensor 17 detects a refrigerant temperature higher than a predetermined one, the evaporation valve 16 is opened. If the thermosensor 17 detects a temperature lower than the predetermined one, the evaporation valve 16 is closed. In the present invention, the electrically actuated valve refers to a generic name of valve means which are opened and closed (of which the opening diameter is increased or decreased) by an electrical force.

Figure 8:
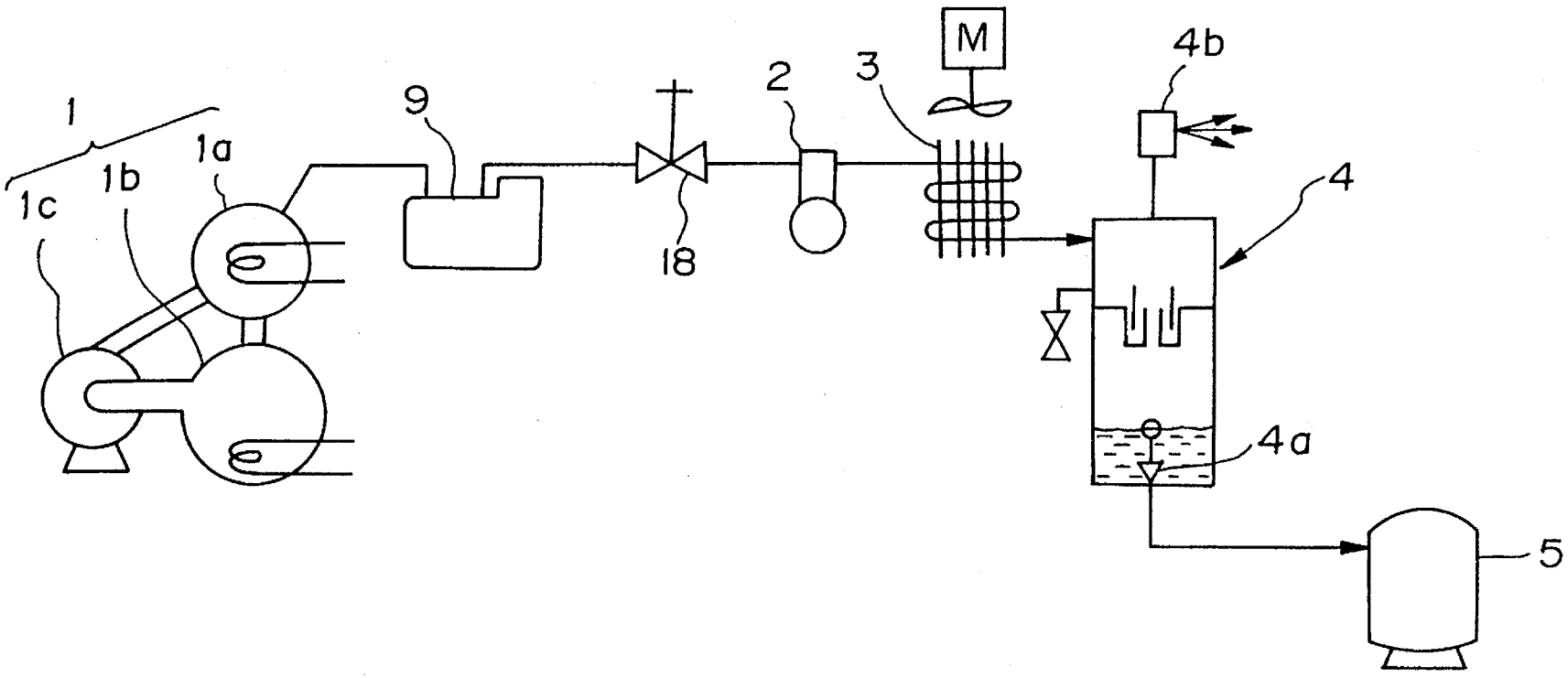
FIG. 8 is a schematic diagram of a fifth embodiment of the refrigerant recovery apparatus according to the present invention.

FIG. 8 schematically shows, as a fifth embodiment, a still further improved version of the embodiment shown in FIG. 3. The embodiment, shown in FIG. 3, in which the vacuum pump 9 and compressor 2 operate serially with each other provides an excellent practical effect which has never been expected with the prior art as previously described. However, the serial operation of different types of pumps causes a technical difficulty. That is, it is necessary to operate the vacuum pump 9 and compressor 2 in a stable state with a high efficiency while keeping the delivery pressure of the vacuum pump 9 well balanced with the suction pressure of the compressor 2. Therefore, a throttle valve 18 is provided between the vacuum pump 9 and compressor 2 in this embodiment. By operating (opening and closing) this throttle valve 18, it is possible to maintain the delivery pressure of the vacuum pump 9 at an appropriate level.

Figure 9:
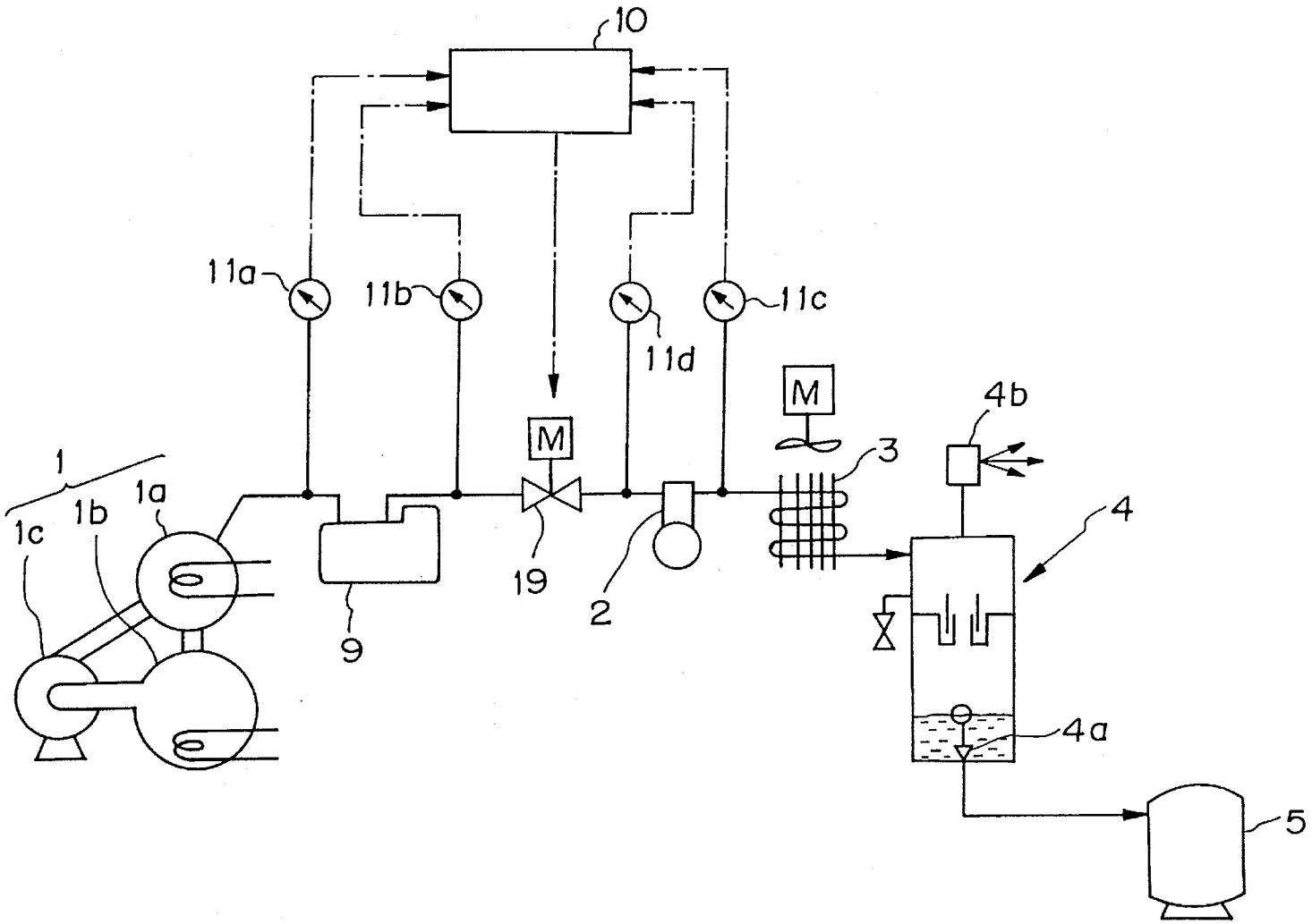
FIG. 9 is a schematic diagram of a sixth embodiment of the refrigerant recovery apparatus according to the present invention.

FIG. 9 schematically shows, as a sixth embodiment, another improved version of the fifth embodiment shown in FIG. 8. According to this sixth embodiment, a electrically actuated throttle valve 19 is provided between the vacuum pump 9 and compressor 2. The electrically actuated throttle valve 19 used in this embodiment is of such a structure that the throttling can be fine adjusted.

Further, the outlet and inlet of each of the vacuum pump 9 and compressor 2 are equipped with pressure gauges 11*a* and 11*b*, and 11*c* and 11*d*, respectively, to drive and control the electrically actuated throttle valve 19 by means of an arithmetic unit 10.

Figure 10:
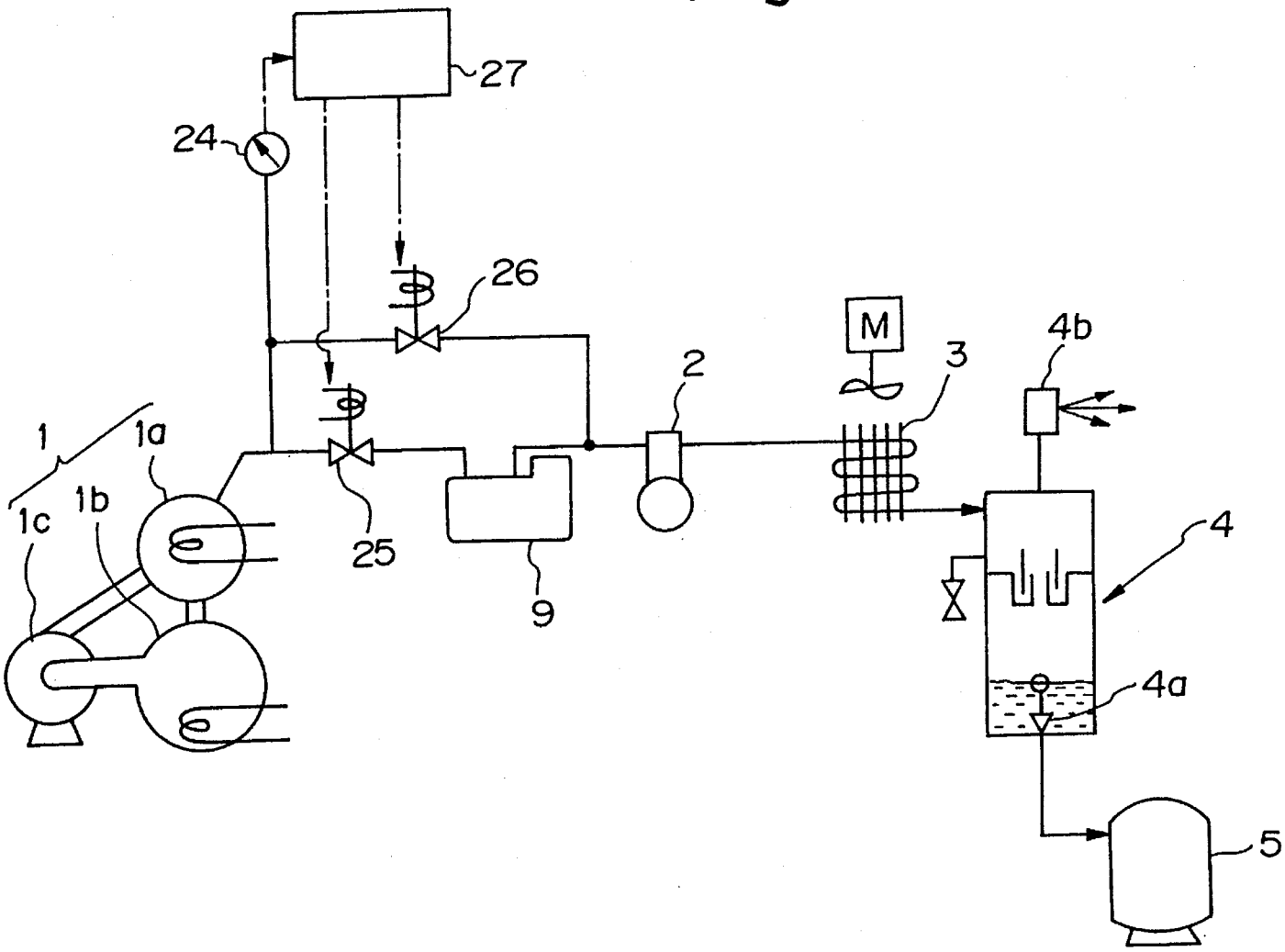
FIG. 10 is a schematic diagram of a seventh embodiment of the refrigerant recovery apparatus according to the present invention.

FIG. 10 schematically shows, as a seventh embodiment, a still yet another improved version of the embodiment shown in FIG. 3. To attain the intended purpose, the embodiment shown in FIG. 3 is so arranged that all the refrigerant gas in the refrigerator 1 is sucked out by the vacuum pump 9. However, the operation of sucking out all the refrigerant gas is required at the end of the recovery process, not at the beginning thereof. Therefore, this seventh embodiment is provided with a solenoid valve 25 connected in series with the vacuum pump 9, and a solenoid valve 26 connected in parallel with the "vacuum pump 9 and serial solenoid valve 25" to bypass these pump 9 and valve 25.

In the initial phase of the recovery process, the pressure in the refrigerator 1 is relatively high. During this phase, the serial solenoid valve 25 is closed and the vacuum pump 9 is put out of operation, while the bypass solenoid valve 26 is opened to progress the recovering operation with the compressor 2 held in independent operation. When the refrigerator 1 is vacuumized or nearly vacuumized, the vacuum pump 9 is put into operation with the serial solenoid valve 25 opened while the vacuum pump 9 and compressor 2 are put into a serial operation with the bypass solenoid valve 26 closed. This embodiment is so arranged that the pressure in the refrigerator 1 is detected by a pressure gauge 24 to control the opening/closing of the serial solenoid valve 25 and bypass solenoid valve 26 by means of an arithmetic unit 27. The above operation can be manually done. In this case, since the frequency of operating these valves is such that the valves are opened once and also closed once per recovery process, there is neither considerable trouble nor much labor consumption.

It will be easily understood from the schematic diagram in FIG. 10 that by appropriately selecting the type of the vacuum pump 9 and its drive and control mechanism, it is also possible to omit or set normally open the serial solenoid valve 25.

Figure 11:
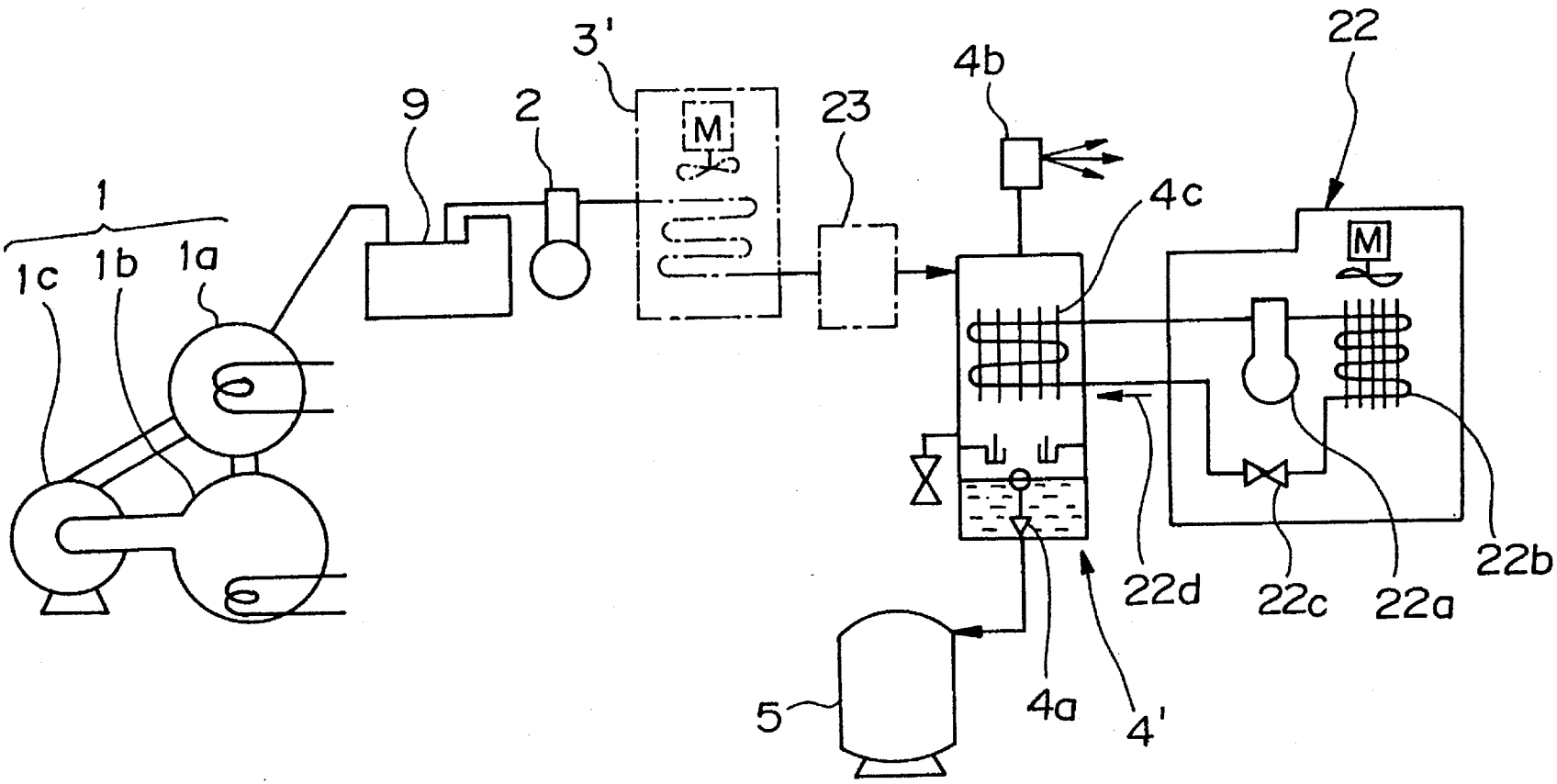
FIG. 11 is a schematic diagram of an eighth embodiment of the refrigerant recovery apparatus according to the present invention.

FIG. 11 schematically shows an eighth embodiment of the present invention, different from the aforementioned embodiments. Briefly speaking, this embodiment has a small refrigerator 22 provided in combination with the liquid separator 4 in the embodiment shown in FIG. 3. The small refrigerator in the present invention refers to smaller and smaller-capacity ones than the refrigerator 1 for which the refrigeration recovery is to be done.

The liquid separator 4' in the eighth embodiment has a cooler 4*c* provided therein. The small refrigerator 22 is provided with a compressor 22*a*, condenser 22*b* and expansion valve 22*c*, and supplies a cooling fluid 22*d* to the cooler 4*c*. The cooling fluid 22*d* recirculates in this circuit. In this embodiment, the refrigerant gas is subject to a forced cooling in the liquid separator 4' so that its vapor pressure is lowered. Thus, the refrigerant gas released along with the non-condensible gases from the safety valve 4*b* is further lowered in density.

The refrigerant gas is forcibly cooled as mentioned above. So in case the cooling temperature is lower than the freezing point of water, steam, if any, in the refrigerant gas will result in a frost or ice in the liquid separator 4', possibly causing an interference with the operation of the valves. Therefore, a dryer 23 should preferably be provided at the inlet of the liquid separator 4'as indicated with an imaginary line to remove the steam. As will easily be understood from FIG. 11, the cooling fluid 22*d* recirculating the refrigerant gas through the cooler 4*c* in the liquid separator 4' to forcibly cool the refrigerant gas may be a cold fluid such as a cold water, brine, refrigerant or the like supplied from any other cooling apparatus, not from the small refrigerator 22. It should be noted that an air-cooling condenser 3' may be provided between the compressor 2 and dryer 23 to enhance the effect of the dryer 23. In this case, the small refrigerator 22 may be of a lower capacity.

FIG. 3 shows an embodiment of the refrigerant recovery apparatus, and FIG. 4 shows an embodiment of the refrigeration purge apparatus having a purge line 32 and bypass valve 31 added to the refrigerant recovery apparatus. Similarly, a purge line and bypass valve may be additionally provided to each of the refrigerant recovery apparatus shown in FIGS. 5 to 9 and 11, respectively. Otherwise, a purge line may be added to the refrigerant recovery apparatus shown in FIG. 10 to build a refrigeration purge apparatus.

What is claimed is:

1. Apparatus for recovering low pressure refrigerant, comprising:

a gas pump for sucking a mixture of the refrigerant gas charged in a refrigerator and non-condensible gases having entered into the refrigerator, and for feeding the gas mixture into a liquid separator;

said gas pump consisting of a vacuum pump and a compressor which are connected in series with each other, said vacuum pump being positioned between said refrigerator and said compressor while said compressor is positioned downstream of said vacuum;

a condenser for cooling the gas mixture delivered from the gas pump, for turning most of the refrigerant gas into liquid refrigerant and for feeding the liquid refrigerant, the gas refrigerant left as gas state, noncondensible gases and condensed condensible contaminants into said liquid separator to recover the refrigerant;

said liquid separator provided with a drain valve to drain contaminants and with a float valve through which refrigerant is recovered;

first electromagnetic valve means connected in series with the vacuum pump;

second electromagnetic valve means connected in parallel with the first electromagnetic valve means and vacuum pump;

pressure sensing means for detecting a pressure in an upstream line common for the first and second electromagnetic valve means; and an arithmetic unit for receiving an output signal from the pressure sensing means and for controlling responsive to the output signal the opening and closing of the first and second electromagnetic valve means.

2. Apparatus for recovering low pressure refrigerant and/or for purging non-condensible gases as set forth in claim 1, further comprising;

a cooler incorporated in the liquid separator, and a small refrigerator provided in combination with the cooler to supply a cooling fluid to the cooler and recirculates it.

3. Apparatus for recovering low pressure refrigerant and/or for purging non-condensible gases as set forth in claim 2, further comprising;

a dryer which is connected as interposed between the suction side of the vacuum pump and the compressor or between the compressor and liquid separator to remove the steam in the flow of refrigerant gas.

4. An apparatus for recovering low pressure refrigerant which is capable of controlling pressure in a refrigerator, comprising:

a gas pump for sucking a mixture of the refrigerant gas charged in the refrigerator and non-condensible gases having entered into the refrigerator, said gas pump including a vacuum pump and a compressor which are connected in series with each other, said compressor being positioned downstream of said vacuum pump;

a condenser positioned downstream of said compressor for cooling the gas mixture delivered from the gas pump;

a liquid separator positioned downstream of said condenser for separating liquid refrigerant from gases;

a serial valve connected in series with said vacuum pump;

a bypass valve positioned in parallel with said serial valve and said vacuum pump along a bypass passage for directing refrigerant around said vacuum pump;

pressure sensing means for detecting and indicating a pressure in an up-stream line common to said serial and said bypass valves, wherein said serial valve and said bypass valve are capable of manual adjustment between respective open and closed positions in response to pressure indications by said pressure sensing means so as to control the pressure in the refrigerator.

5. A refrigeration recovery apparatus as set forth in claim 4, further including a purge means for purging non-condensible gases from the apparatus, said purge means including a purge passage connected to the apparatus between said liquid separator and the refrigerator.

6. Apparatus for purging non-condensible gases, comprising:

a gas pump for sucking a mixture of the refrigerant gas charged in a refrigerator and non-condensible gases having entered into the refrigerator, and for feeding the gas mixture into a liquid separator;

said gas pump consisting of a vacuum pump and a compressor which are connected in series with each other downstream of said refrigerator;

a condenser for cooling the gas mixture delivered from the gas pump, for turning most of the refrigerant gas into liquid refrigerant and for feeding the liquid refrigerant, the gas refrigerant left as gas state, noncondensible gases and condensed condensible contaminants into a liquid separator to purge non-condensible gases and condensible contaminants;

said liquid separator provided with a safety valve through which non-condensible gases are purged and with a drain valve to drain contaminants;

first electromagnetic valve means connected in series with the vacuum pump;

second electromagnetic valve means connected in parallel with the first electromagnetic valve means and vacuum pump;

pressure sensing means for detecting a pressure in an upstream line common for the first and second electromagnetic valve means; and an arithmetic unit for receiving an output signal from the pressure sensing means and for controlling responsive to the output signal the opening and closing of the first and second electromagnetic valve means.

7. Apparatus for recovering low pressure refrigerant and for purging non-condensible gases, comprising:

a gas pump for sucking a mixture of the refrigerant gas charged in a refrigerator and non-condensible gases having entered into the refrigerator, and for feeding the gas mixture into a liquid separator;

said gas pump consisting of a vacuum pump and a compressor which are connected in series with each other, said vacuum pump being positioned between said refrigerator and said compressor while said compressor is positioned downstream of said vacuum pump;

a condenser for cooling the gas mixture delivered from the gas pump, for turning most of the refrigerant gas into liquid refrigerant and for feeding the liquid refrigerant, the gas refrigerant left as gas state, noncondensible gases and condensed condensible contaminants into a liquid separator to recover the refrigerant and purge non-condensible gases and condensible contaminants;

said liquid separator provided with a safety valve through which non-condensible gases are purged, with a drain valve to drain contaminants and with a float valve through which refrigerant is recovered;

first electromagnetic valve means connected in series with the vacuum pump;

second electromagnetic valve means connected in parallel with the first electromagnetic valve means and vacuum pump;

pressure sensing means for detecting a pressure in an upstream line common for the first and second electromagnetic valve means; and an arithmetic unit for receiving an output signal from the pressure sensing means and for controlling responsive to the output signal the opening and closing of the first and second electromagnetic valve means.

* * * * *